US008322266B2

(12) United States Patent
Presz, Jr. et al.

(10) Patent No.: US 8,322,266 B2
(45) Date of Patent: Dec. 4, 2012

(54) CONTROLLED-UNAIDED SURGE AND PURGE SUPPRESSORS FOR FIREARM MUZZLES

(75) Inventors: Walter M. Presz, Jr., Wilbraham, MA (US); Michael J. Werle, West Hartford, CT (US); Bart Lipkens, Hampden, MA (US)

(73) Assignee: Flodesign, Inc., Wilbraham, MA (US)

( * ) Notice: Subject to any disclaimer, the term of this patent is extended or adjusted under 35 U.S.C. 154(b) by 749 days.

(21) Appl. No.: 12/212,166

(22) Filed: Sep. 17, 2008

(65) Prior Publication Data

US 2011/0107900 A1 May 12, 2011

Related U.S. Application Data

(60) Provisional application No. 60/994,280, filed on Sep. 18, 2007.

(51) Int. Cl.
*F41A 21/30* (2006.01)

(52) U.S. Cl. ..... 89/14.4; 89/14.2

(58) Field of Classification Search ..... 89/14.05–14.5
See application file for complete search history.

(56) References Cited

U.S. PATENT DOCUMENTS

| | | | | |
|---|---|---|---|---|
| 1,551,617 | A * | 9/1925 | Pohlmann | 89/14.1 |
| 1,860,276 | A | 5/1932 | De Luce et al. | |
| 2,636,563 | A | 11/1944 | Vinson | |
| 4,291,610 | A | 9/1981 | Waiser | |
| 5,761,900 | A | 6/1998 | Presz, Jr. | |
| 6,311,928 | B1 * | 11/2001 | Presz et al. | 244/110 B |
| 7,073,426 | B1 | 7/2006 | White | |
| 2006/0151633 | A1 * | 7/2006 | Presz et al. | 239/461 |

FOREIGN PATENT DOCUMENTS

| | | |
|---|---|---|
| FR | 825016 | 2/1938 |
| FR | 981869 | 5/1951 |
| WO | WO 83/01680 | 5/1983 |
| WO | WO 99/27317 | 3/1999 |

* cited by examiner

*Primary Examiner* — Gabriel Klein
(74) *Attorney, Agent, or Firm* — Richard M. Klein; Fay Sharpe LLP

(57) ABSTRACT

A Controlled Unaided Surge and Purge (CUSPS) suppressor for firearms uses the blast and plume characteristics inherent to the ballistic discharge process to develop a new two-step controlled surge and purge system centered around advanced mixer-ejector concepts. The blast surge noise is reduced by controlling the flow expansion, and the flash effects are reduced by controlling inflow and outflow gas purges. In the preferred embodiment, suppressor vent holes are convergently contoured to better reduce the blast surge. Preferably a two-stage supersonic mixer/ejector system, in combination with adjacent vent holes in the suppressor housing and a divergent entrance nozzle, is used to control or eliminate the external Mach disk, while rapidly mixing and diluting the propellant with purged gases. A diffuser downstream of the mixer/ejector system further increases ejector performance and pumping. The pumped gases are used to self-clean and cool the CUSPS suppressor.

6 Claims, 16 Drawing Sheets

CONTROLLED-UNAIDED SURGE AND PURGE SUPPRESSORS FOR FIREARM MUZZLES

RELATED APPLICATION

This application claims priority from Applicants' U.S. Provisional Patent Application, Ser. No. 60/994,280, filed Sep. 18, 2007 (hereinafter "Applicants' Provisional Application"). Applicants hereby incorporate the disclosure of Applicants' Provisional Application by reference.

FIELD OF INVENTION

The present invention deals generally with firearms. More particularly, it deals with noise and flash suppressors for firearm muzzles.

BACKGROUND OF INVENTION

Reducing muzzle noise and flash from military and security personnel firearms (e.g., long guns and pistols) provide a significant tactical advantage in the field. Existing suppression technology reduces noise and flash, but comparatively little science exists to explain how current designs can be modified or replaced to provide enhanced suppressor performance, including the useful life span of the suppressor. Furthermore, even less design guidance exists that can lead to integration of suppressors into a firearm's barrel assembly. Lessons learned as a result of the ongoing military and homeland security based conflicts have indicated that increased use of current suppressors, as part of everyday operations, have led to shortened life cycles of suppressors, increased maintenance (and sometimes damage) of weapons, and considerable variability in weapon accuracy.

To set the stage for developing improved suppressors, it is necessary first to identify the critical elements of the attendant flow fields as thoroughly documented in Klingenberg, Firearmter and Heimerl, Joseph M., Firearm Muzzle Blast and Flash, AIAA Progress in Astronautics and Aeronautics, Volume 139, 1992.

These characteristics can be broken down into three core elements. The first two core elements are: the precursor blast; and a main blast set up by the expanding gases. The precursor blast consists of mostly air with a small amount of propellant and the main blast is made up of spherical pressure waves that quickly overtake the fired projectile. Both of these blasts are sources of low frequency noise that carry very far distances. The third core element is the highly visible gas flash which follows the blast.

In general, a gas flash occurs because air mixes with the fuel rich propellants and the high temperatures from the blast waves. The result of this mixture forms a gas flash which is greatly increased in the secondary flow region that occurs away from the muzzle of a firearm.

When a gas flash forms, it occurs in three parts: primary, intermediate, and secondary flashes. The primary flash forms at the muzzle in the supersonic flow region and is very small. An intermediate flash occurs directly behind the projectile, but in front of the Mach disk leading any supersonic flow region. (Not all firearms have supersonic discharge flows.) The secondary flash is the most severe, and it occurs downstream of the firearm muzzle, and after the normal shock resulting from the muzzle gas over-expansion. The large flash seen when firing a projectile is actually the secondary flash.

With an understanding of the three core elements involved in the blast and flash from a projectile, the individual components can be analyzed to assess their critical components.

Considering the principal characteristics of the blast wave, Applicants have found that it is essentially a spherical blast wave that travels rapidly but also decays rapidly both strength-wise and time/distance-wise. Relative to the flow-field attendant to the flash, it establishes after or behind the main blast wave with a structure very similar to that of a traditional under-expanded jet plume often seen in propulsion applications. The key elements of the post-blast wave flow field are the free jet boundary and the highly under-expanded jet flow region all flowing strongly in the downstream axial direction. The over-expanded gas results in the normal shock or Mach disk, which causes the secondary flash and a significant portion of the noise. The important point is that the key physics of this type of flow structure is common in propulsion aerodynamics, and can be used to generate performance correlations for use in developing more efficient suppressor designs.

Within the firearms art, it is well known that a fired gun produces a sudden blast wave which is key to noise generation. That type of sudden blast wave is not present in a jet engine during flight.

There are a wide range of firearm suppressor designs. See, for example, the Prior Art shown in Applicants' FIGS. 1A-1D, All current designs apparently have three recurrent features: 1.) a circular or near circular cross-section with a diameter approximately five times the firearm's muzzle diameter; 2.) a solid outer surface so no gases can enter or escape the suppressor except through its entrance and exit ports; and 3.) complex flow nozzles, baffles and/or chambers interior to the suppressor for capturing the muzzle gases and mitigating the blast over-pressure level.

An alternate means of controlling supersonic flows, originally developed for propulsion applications, involves the use of flow mixer-ejectors, as discussed in U.S. Pat. No. 5,884,472 to Walter M Presz, Jr. and Gary Reynolds. Ejectors are well-known and documented fluid jet pumps that draw flow into a system and thereby increase the flow rate through that system. Mixer/ejectors are short compact versions of such jet pumps that are relatively insensitive to incoming flow conditions and have been used extensively in high-speed jet propulsion applications involving flow velocities near or above the speed of sound. See, for example, U.S. Pat. No. 5,761,900 to Walter M. Presz, Jr., which also uses a mixer downstream of a gas turbine nozzle to increase thrust while reducing noise from the discharge. Dr. Presz is a co-inventor in the present application. An ejector is a fluid dynamic pump with no moving parts.

Ejectors use viscous forces to lower the velocity and energy of a jet stream by ingesting lower energy flow which can lead to flow characteristics that may augment thrust, cool exhaust gases, suppress jet infrared signature, and importantly to ballistic applications, reduce attendant noise and flash. Mixers improve the performance characteristics of ejectors by inducing stirring, or axial vortices, that promote rapid mixing of the high velocity primary jet with the cooler, and sometimes heavier, ingested gas; thus resulting in more compact devices. Numerous patented products have derived from this concept. The mixer/ejector concept is well accepted within the aviation and jet propulsion community as an extremely efficient solution to aircraft noise and exhaust temperature suppression.

Gas turbine technology has yet to be applied successfully to firearm muzzle suppressors. If one were to replace an under-expanded jet engine exhaust for a ballistic blast from a firearm, in which hot gases are mixed and expelled with a projectile over the length of the barrel, it may be seen that such a technology could significantly reduce noise, flash, and provide outside air to the barrel that could be employed to cool and clean the suppressor components.

Accordingly, it is a primary objective of the present invention to provide a firearm suppressor that employs advanced fluid dynamic ejector pump principles to consistently deliver levels of noise and flash suppressor equal to or better than current suppressors.

It is another primary objective to provide an improved firearm suppressor with significantly increased useful life span over that of current firearm suppressors.

It is another primary objective to provide a self-cleaning, self-cooling firearm suppressor using mixer/ejector technology.

It is another primary objective to provide an improved firearm suppressor using mixer/ejector technology to control the muzzle blast wave and overexpansion flow for better suppression.

It is another object, commensurate with the above-listed objects, to provide an improved suppressor which is durable and safe to use.

SUMMARY OF INVENTION

Applicants have developed an improved firearm suppressor through the use of advanced mixer/ejector concepts. By recognizing and analyzing the blast and plume characteristics, inherent in ballistic discharges, Applicants have created a new two-step controlled unaided surge and purge system (nicknamed "CUSPS") for firearm suppressors.

This new CUSPS approach attends to the blast surge effects by controlling the flow expansion into the suppressor, and attends to the flash effects by controlling inflow and outflow gas purging. The CUSPS suppressor rapidly reduces the pressure energy associated with a firearm muzzle blast before it exits the suppressor, thereby reducing noise and muzzle flash. The blast surge is mitigated through a rapid, divergent nozzle volume increase and thereafter through a series of vent holes strategically located around the suppressor outer wall. Applicants anticipate the noise frequency spectrum of the blast will be controllable through careful design of the hole contours, size and placement. The vent holes preferably converge towards the outside of the CUSPS. Alternatively, the holes could be contoured with divergent or convergent/divergent area distributions.

Following this, air is ingested inward through the same holes, mixed with the muzzle gases and purged axially through the exit port and vent holes. Preferably a two-stage supersonic mixer/ejector is used in the CUSPS suppressor to control or eliminate the Mach disk, while rapidly mixing and diluting the propellant with ambient air.

Based upon preliminary testing, Applicants believe that their CUSPS suppressor will generate the following benefits: lower noise; hide or eliminates flash; integrate cooling and self-cleaning; maintain firearm accuracy at longer distances, and lessen the amount of powder residue inside barrels.

Figure 5A:
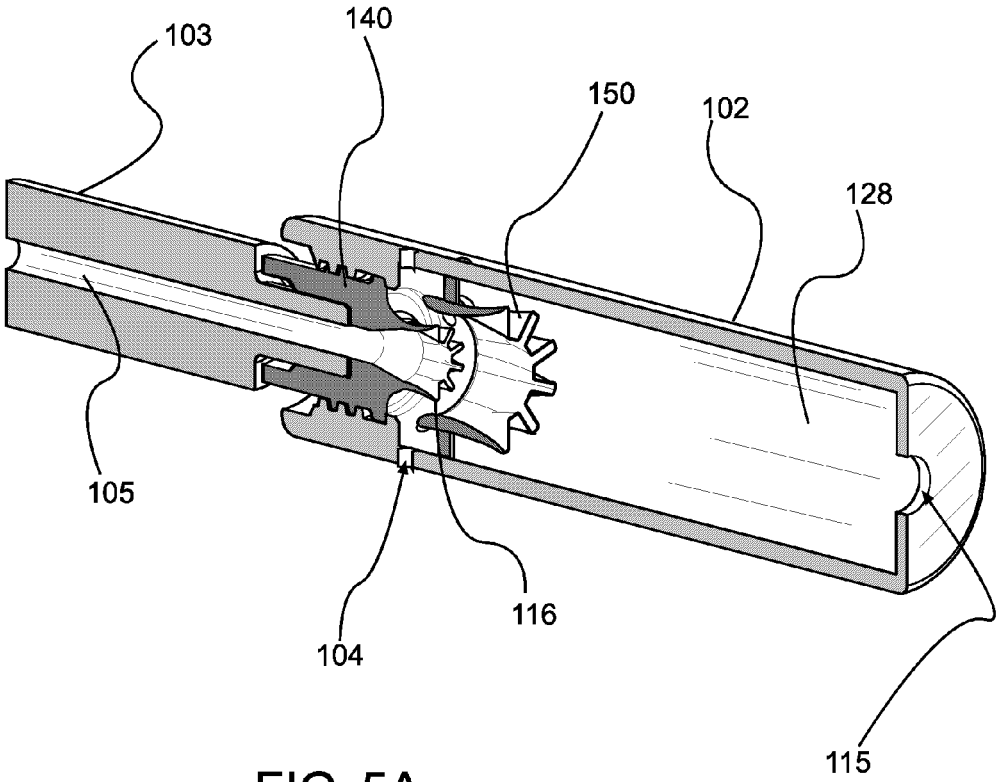
FIG. 5A is a perspective view, with portions broken away, of another alternate embodiment of Applicants' CUSPS suppressor with a mixer shroud system detached from an entrance mixer nozzle forming a two-stage mixer/ejector.
Figure 6:
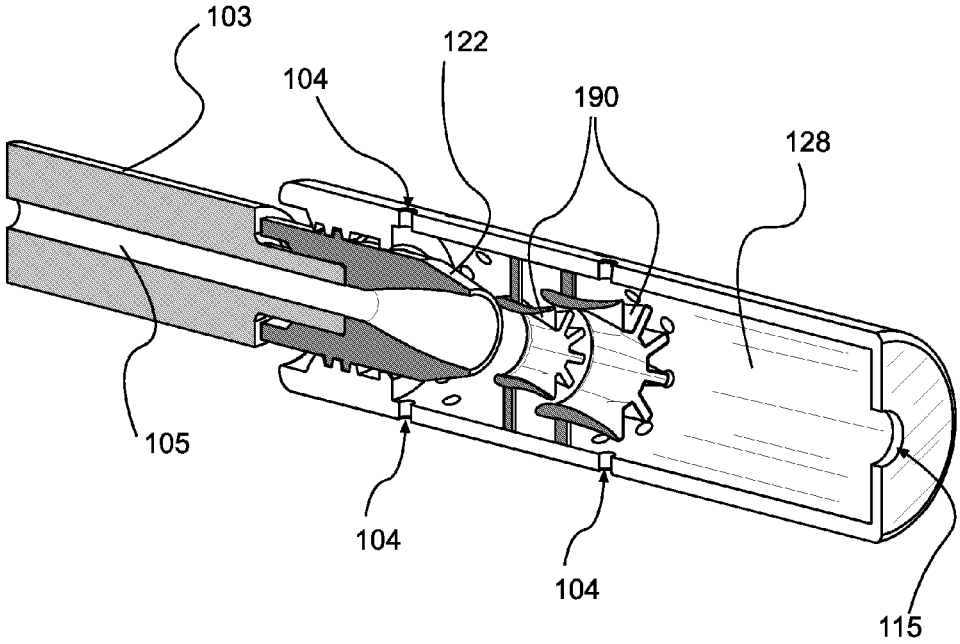
Figure 7:
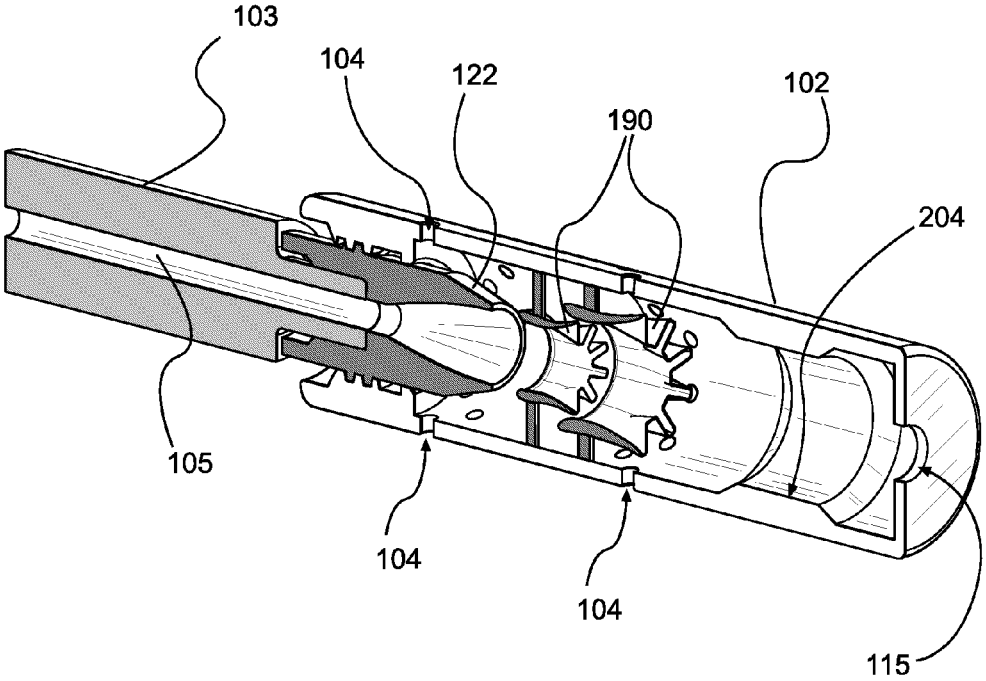
Figure 8A:
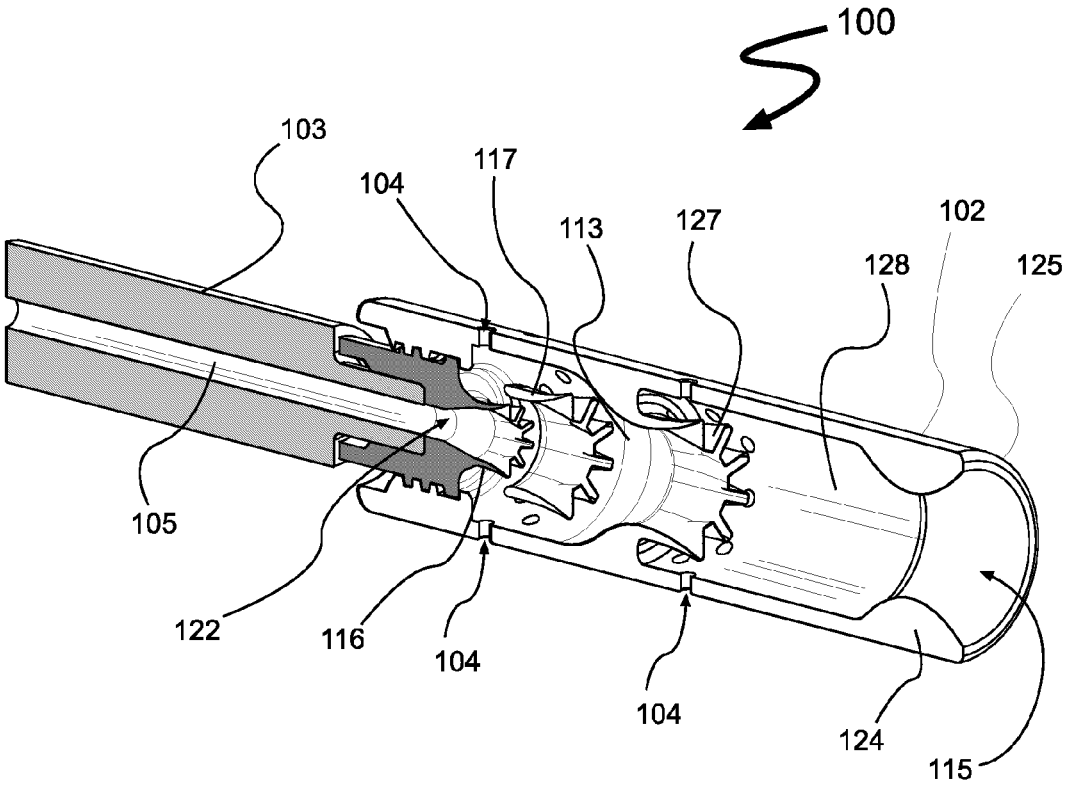
Figure 8B:
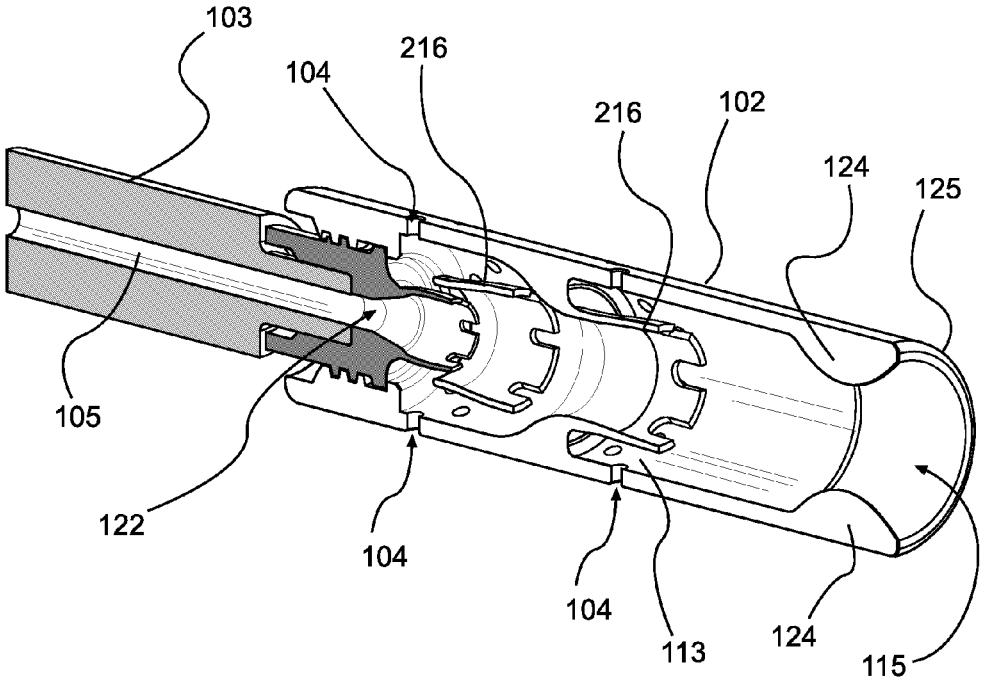
Figure 8C:
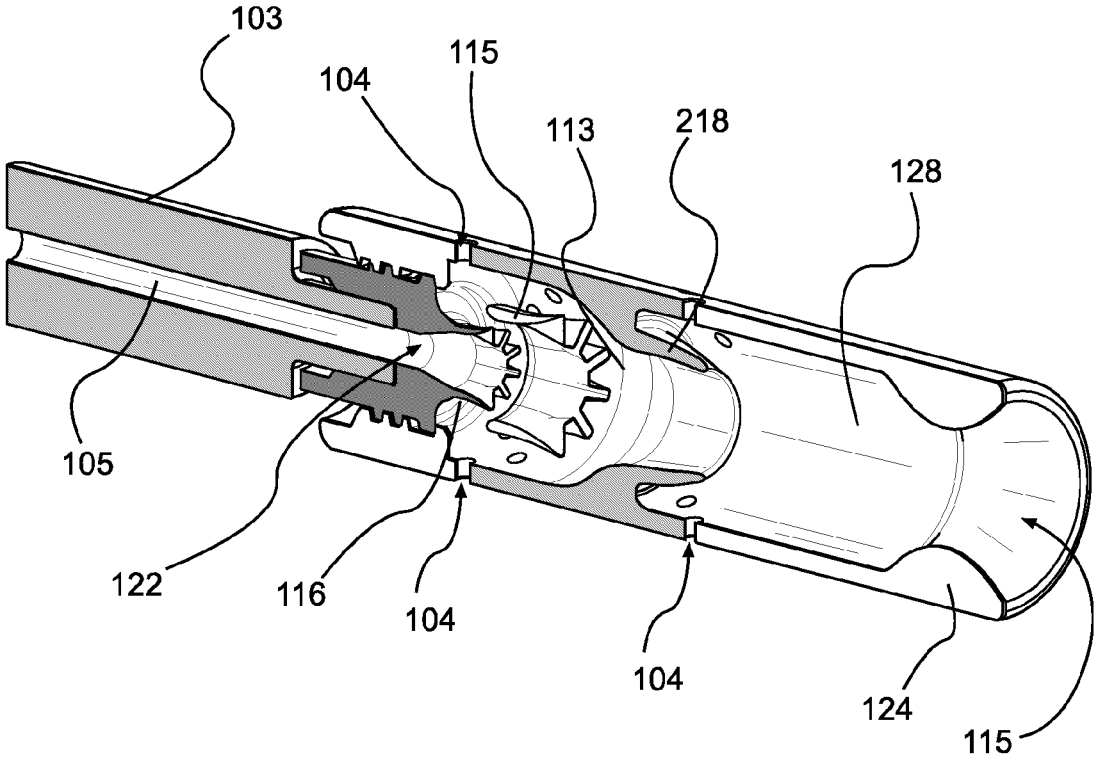
Figure 9:
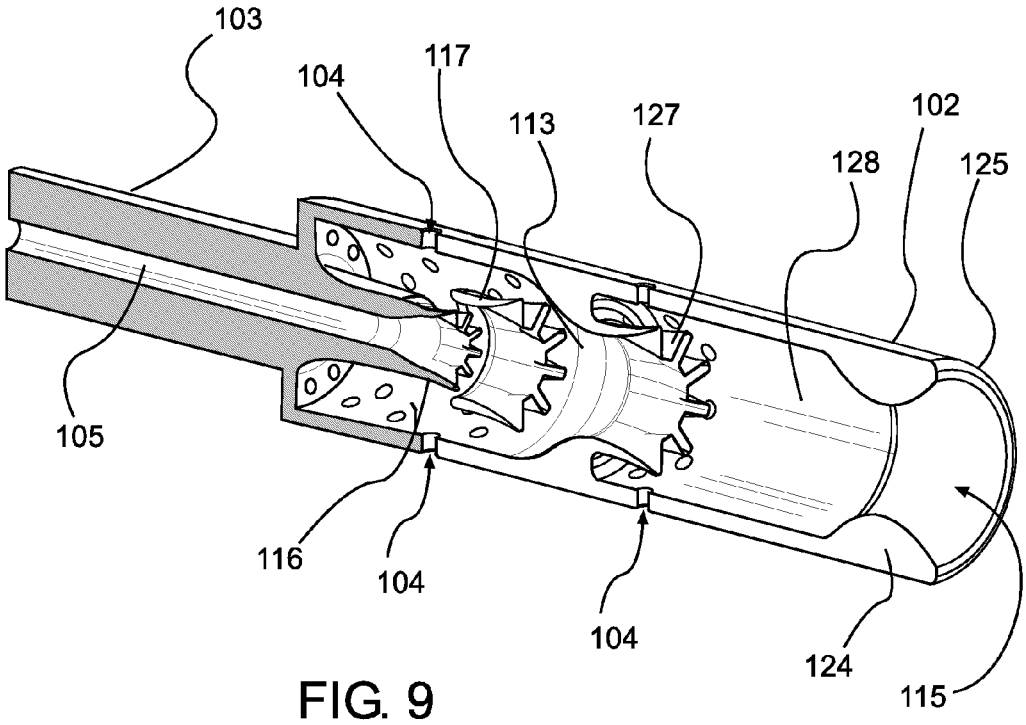
Figure 10A:
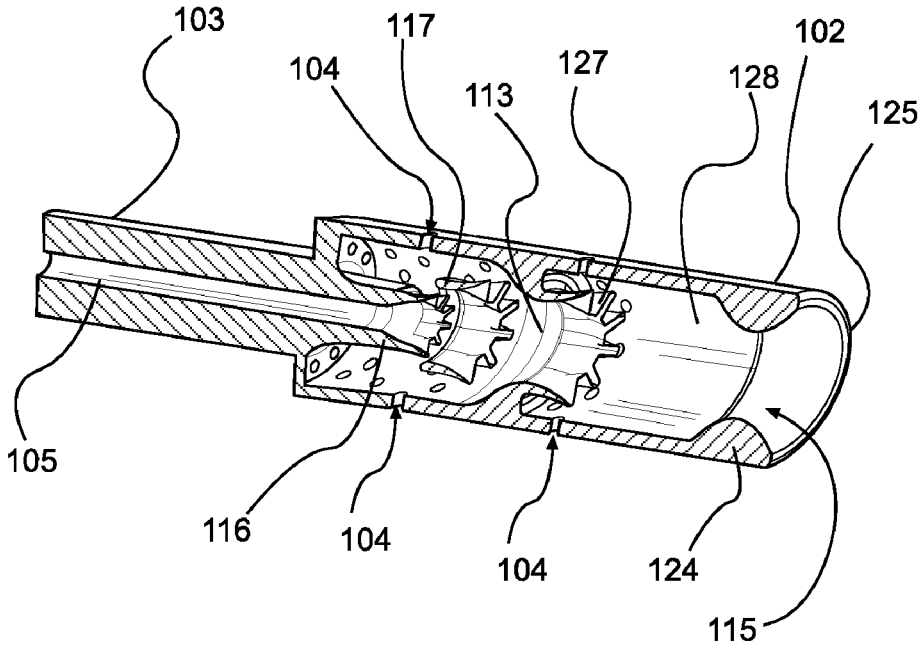
Figure 10B:
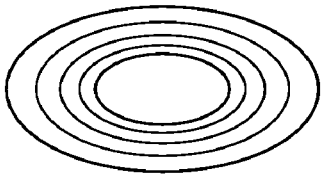

FIG. SB shows the same two-stage mixer/ejector system of FIG. 5A, but with vent holes added to the exit port location of the suppressor;

FIG. 6 is a perspective view, with portions broken away, of another alternate embodiment of Applicants' CUSPS suppressor with a mixer/ejector system detached from the divergent entrance nozzle forming a three-stage ejector system;

FIG. 7 is a perspective view, with portions broken away, of another alternate embodiment of Applicants' CUSPS suppressor with a mixer/ejector system detached from the divergent entrance nozzle, forming a three-stage ejector system, and a convergent-divergent supersonic diffuser in an expansion chamber of the suppressor;

FIG. 8A shows a perspective views, with portions broken away, of Applicants' preferred CUSPS embodiment: a detachable suppressor with two expansion chambers; a first-stage mixer/ejector in a first expansion chamber comprising a lobed nozzle at the entrance to the first expansion chamber a lobed ejector, and vent holes to draw in outside air; a second-stage mixer/ejector comprising a lobed nozzle which extends into a second expansion chamber where vent holes are placed to draw in outside air, and a convergent-divergent diffuser as part of the suppressor exit port;

FIG. 8B shows the same system, as in FIG. 8A, but with slotted nozzles replacing the lobed nozzle;

FIG. 8C shows the same system, as in FIG. SB, but with a round convergent nozzle at the entrance of the second expansion chamber;

FIG. 9 shows an integrated barrel CUSPS with ejector vent holes before the barrel exit and surrounding the barrel;

FIG. 10A shows an integrated barrel CUSPS having a different shaped housing; and FIG. 10B is a right-hand end view of FIG. 10A showing the housing is oval.

DETAILED DESCRIPTION OF PREFERRED EMBODIMENTS

Referring to the drawings in detail, FIGS. 2A-10A show alternate embodiments of Applicants CUSPS suppressor for firearms. Like elements in the drawings use the same element numbers.

In the preferred embodiment 100 (see FIG. 8A), the CUSPS is a detachable firearm suppressor comprising:

a. a tubular housing 102, removably affixed to and axially aligned with the muzzle end of a firearm barrel 103, wherein the housing 102 has vent openings 104 radially and longitudinally distributed in its outer surface or wall, and the housing 102 contains:

i. a projectile entrance port 105, adjacent the terminus, that allows the blast wave and exit gas from a discharged firearm to expand inside the housing 102;

ii. a projectile exit port 114 and internal support structure at its terminus, wherein the preferred exit port is an exit hole 115 in the housing which is significantly larger than the bore (i.e. hole) 105 of the barrel 103; and iii. a one-stage mixer/ejector in an expansion chamber 113, comprising a lobed mixer nozzle 116 at the projectile entrance location 105 and a lobed ejector 117, wherein the mixer/ejector is adapted in size and shape to use the kinetic energy of the firearm's exit gases to pump external or ambient an in and through the suppressor vent holes 104 for cooling and/or cleaning the suppressor (and to a lesser degree cool the gun's muzzle end), and wherein contours of internal lobes for the mixer 116 and ejector 117 interact within the tubular housing 102 to mix ingested ambient air, drawn in through the vent holes 104, with the firearm's exit gases to reduce firearm noise and flash;

iv. wherein the expansion chamber 113 allows the mixed and pumped air and firearm's exit gases to expand within the chamber to increase pressure loss and reduce noise;

v. a round divergent nozzle 122, at the projectile entrance port 105, having a divergent area distribution adapted in size and shape to reduce flow over-expansion and shock formation, thus reducing flash; and vi. a convergent-divergent diffuser 124, or alternately (though not preferred) a contoured nozzle at the suppressor exit 125 to maximize ejector pumping efficiencies.

The preferred embodiment (see FIG. 8A) also includes a second-stage mixer/ejector system comprising: a lobed nozzle 127 which surrounds an end of the lobed ejector nozzle 117 and extends downstream into a second chamber 128; and vent holes 104 in the second chamber to draw in outside air.

Though not shown, the vent holes 104 are preferably convergent. They narrow towards the outside of the suppressor.

Figure 1A:
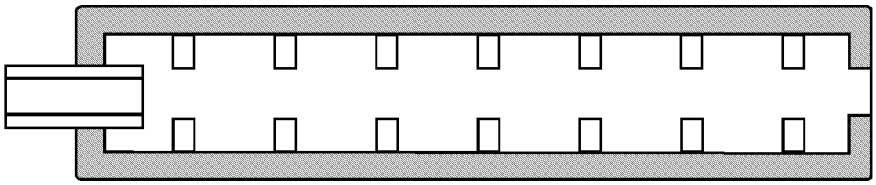
FIG. 1A (Prior Art)
FIGS. 1A-1D, labeled "Prior Art", illustrate four examples of prior firearm suppressors: conventional silencers (FIG. 1A); silencers with absorbent material (FIG. 1B); silencers with two-stage divergent diffuser (FIG. 1C); and silencers with three-stage divergent diffusers (FIG. 1D).
Figure 1B:
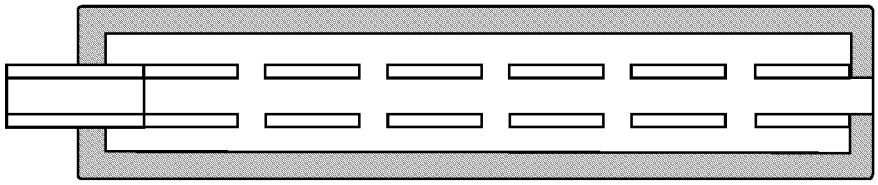
FIG. 1B (Prior Art)
Figure 1C:
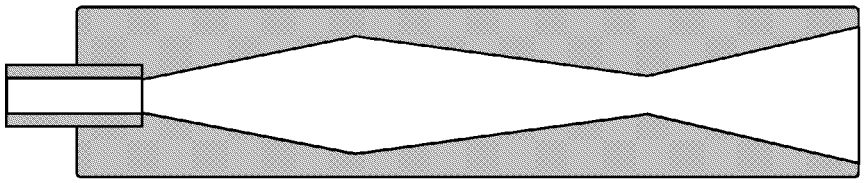
FIG. 1C (Prior Art)
Figure 1D:
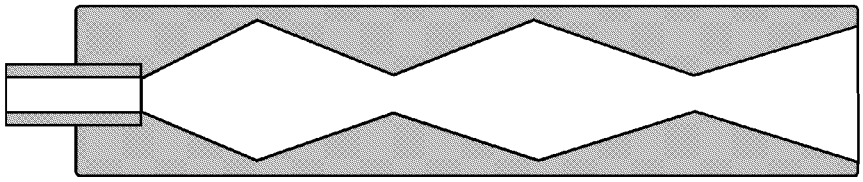
FIG. 1D (Prior Art)
Figure 2A:
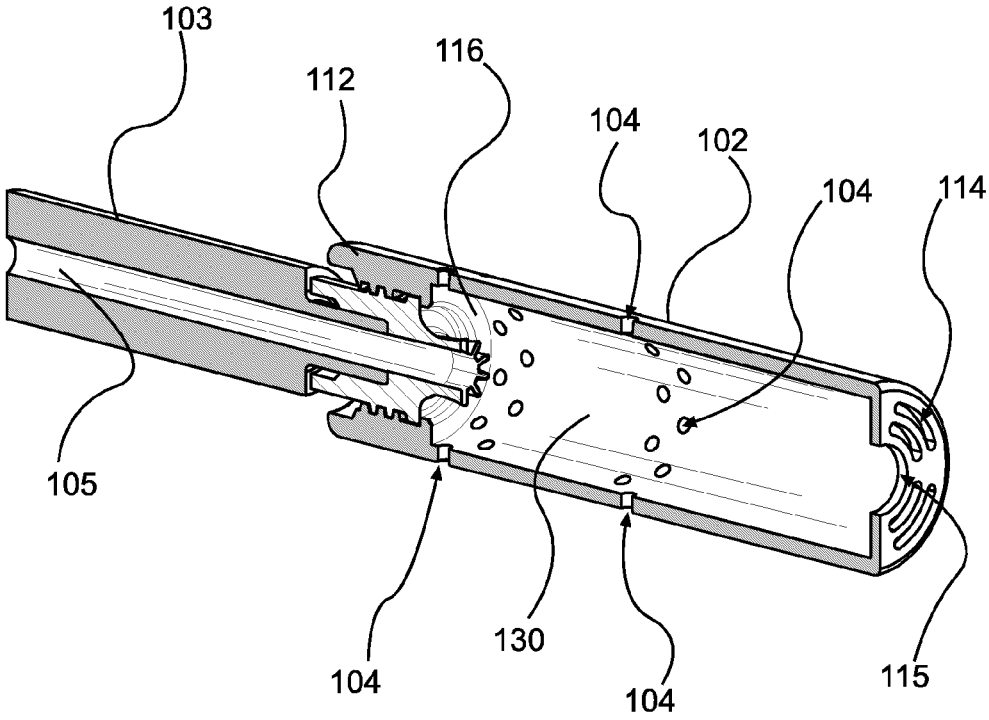
FIG. 2A is a perspective view, with portions broken away and removed, of an alternate embodiment of Applicants' CUSPS suppressor having a housing, a lobed mixer nozzle at a projectile entrance location, a "straight" expansion chamber inside the housing, and vent openings or holes distributed in the housing.

FIG. 2A depicts an alternate embodiment of Applicants' CUSPS suppressor having a housing 102, a lobed mixer nozzle 116 at a projectile entrance location, a "straight" expansion chamber 130 with a constant diameter inside the housing, vent openings or holes 104 distributed in the housing; and slots or holes 114 at the suppressor exit plane.

Figure 2B:
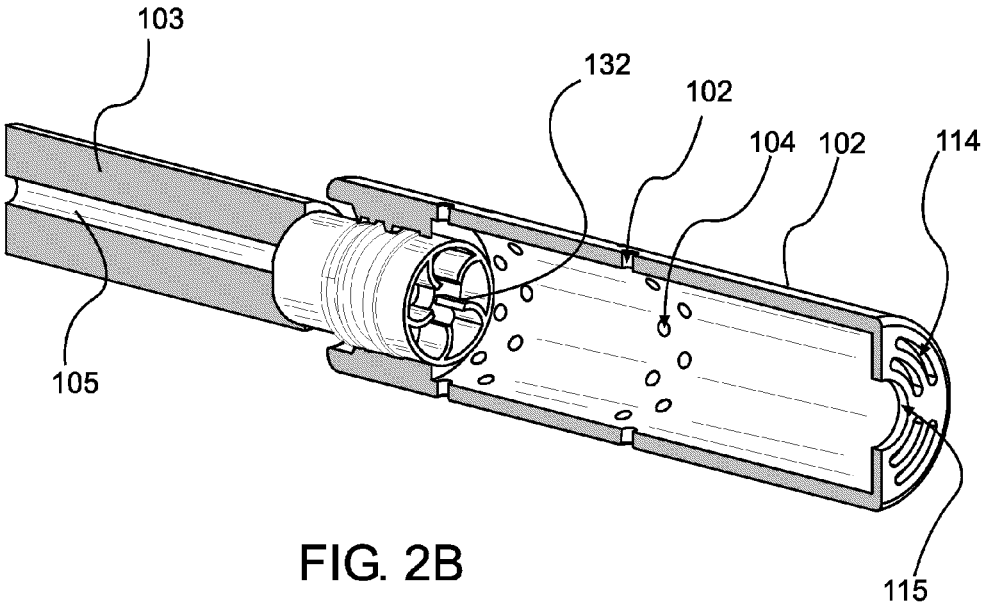
FIG. 2B is a perspective view, with portions broken away, of another alternate embodiment of Applicants CUSPS suppressor with a swirl nozzle at the projectile entrance location instead of the lobed nozzle of FIG. 2A.

FIG. 2B depicts an alternate embodiment of Applicants' CUSPS suppressor with a swirl nozzle 132 at the projectile entrance location, instead of Applicants preferred lobed nozzle, and vent holes 104 distributed in the housing 102.

Figure 2C:
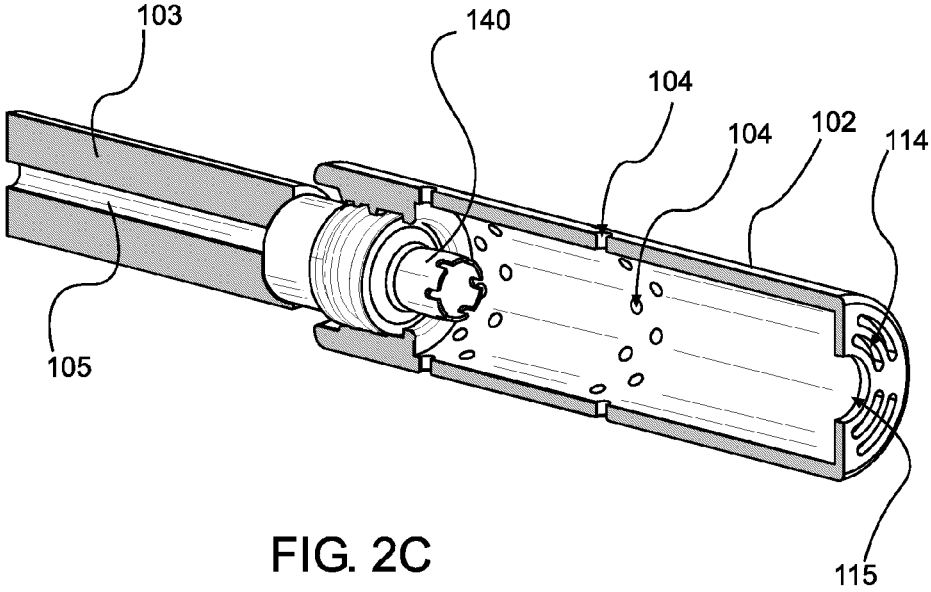
FIG. 2C is a perspective view, with portions broken away, of another embodiment of Applicants' CUSPS suppressor with a slotted nozzle at the projectile entrance location instead of a swirl nozzle or a lobed nozzle.

FIG. 2C depicts another embodiment of Applicants' CUSPS suppressor with a slotted nozzle 140 at the projectile entrance location, instead of a swirl nozzle 126 or a lobed nozzle 116, and vent holes 104 distributed in the housing 102.

Figure 3:
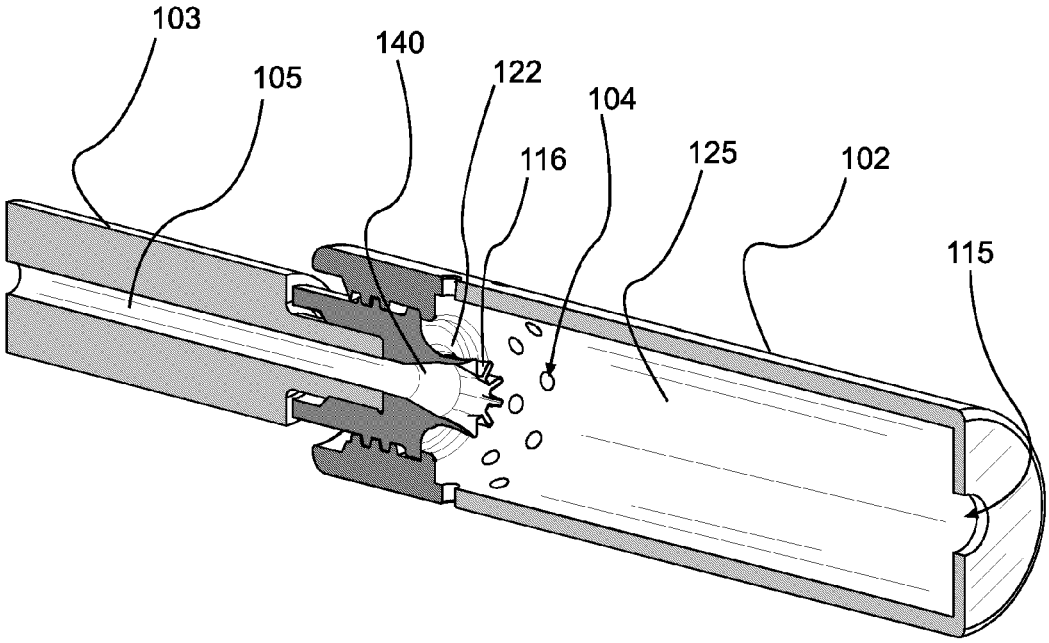
FIG. 3 is a perspective view, with portions broken away, of another alternate embodiment of Applicants' CUSPS suppressor showing a divergent round nozzle at the projectile entrance location before the entrance lobed nozzle, and a single-stage ejector formed by the vent openings distributed on the suppressor outer surface.

FIG. 3 depicts another embodiment of Applicant's CUSPS suppressor with a lobed nozzle 116 attached to a round divergent nozzle 122 at the projectile entrance allocation and vent holes 104 distributed in the housing 102.

Figure 4:
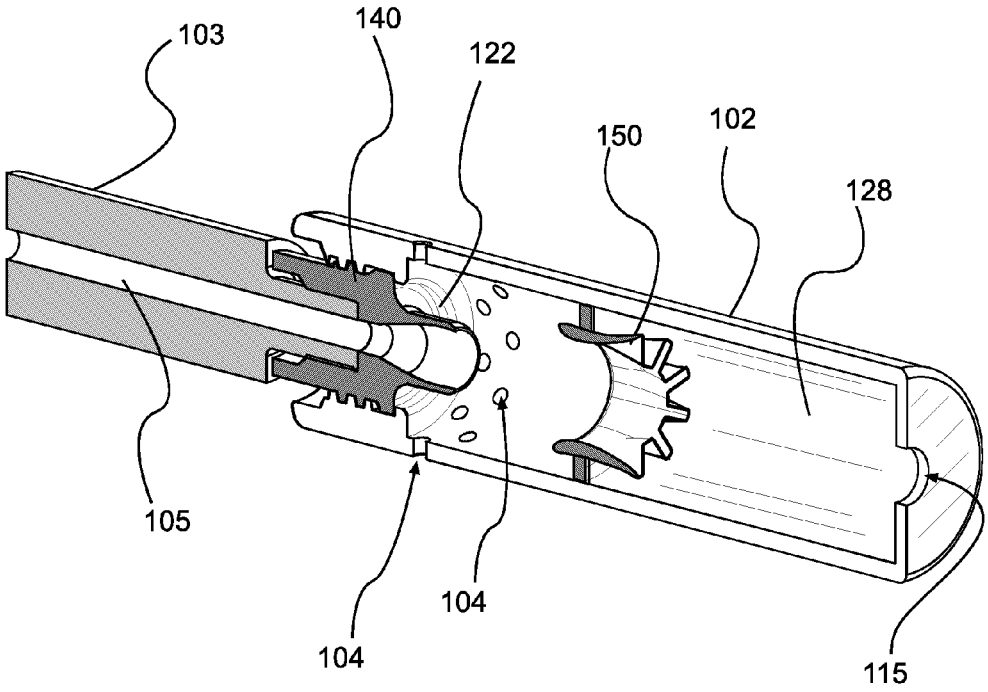
FIG. 4 is a perspective view, with portions broken away, of another alternate embodiment of Applicants' CUSPS suppressor with a mixer shroud system detached from a divergent round entrance nozzle forming a two-stage ejector.

FIG. 4 depicts another alternate embodiment of Applicants' preferred CUSPS suppressor with a mixer shroud system 150, detached from a divergent round entrance nozzle 152, forming a two-stage ejector using vent openings 104 for the ejector distributed in the housing 102.

FIG. 5A depicts another alternate embodiment of Applicants' CUSPS suppressor with a mixer shroud 150 attached to the mixer nozzle 116 forming a two-stage mixer/ejector system 180 with vent openings 104 to draw in outside air.

Figure 5B:
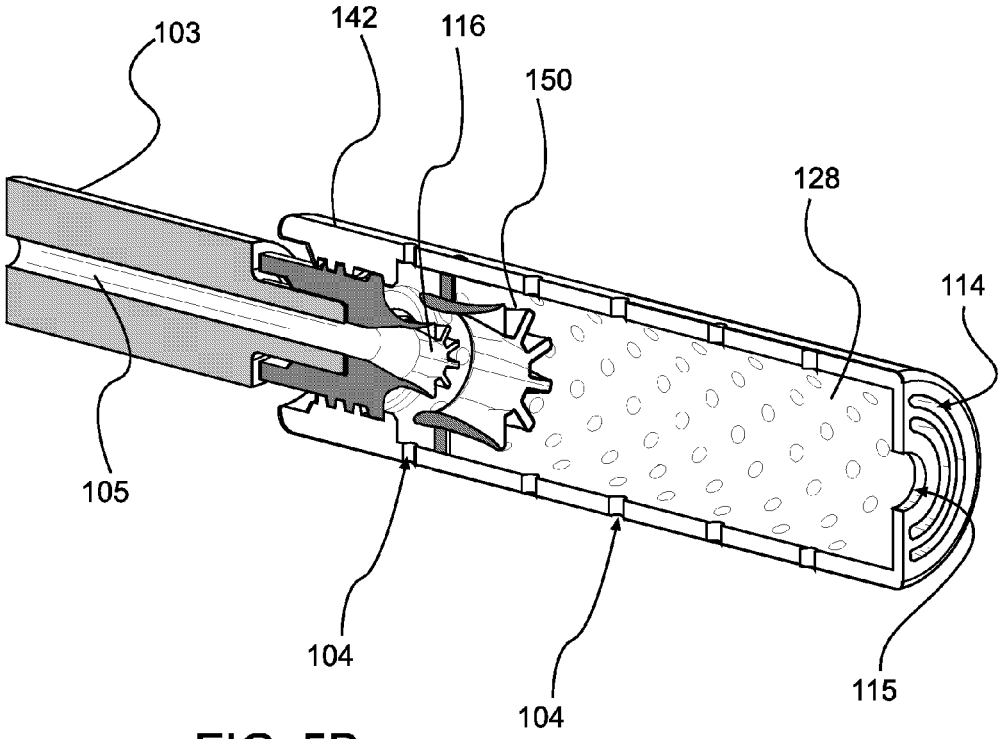

FIG. 5B shows the same mixer/ejector system of FIG. 5A, but with vent holes 114 added to the exit port location 115 of the suppressor, FIG. 6 depicts another alternate embodiment of Applicants' CUSPS suppressor. This embodiment includes a mixer/ejector system 190 detached from the convergent entrance nozzle 152 forming a three-stage ejector system, and vent openings 104 distributed in the housing 102.

FIG. 7 depicts an alternate embodiment of Applicants' CUSPS suppressor with a mixer/ejector system 190 detached from the divergent entrance nozzle 122, forming a three-stage ejector system, vent openings 104 distributed in the housing's outer wall, and a convergent-divergent supersonic diffuser 204 in the expansion chamber 206 of the suppressor.

FIGS. SB and 8C depict additional embodiments of Applicants' CUSPS suppressor, in which: FIG. 8B shows the same system, as in FIG. 8A, but with slotted nozzles (like 140 in FIG. 2C) replacing the lobed nozzles 116; and FIG. 8C shows the same system, as in FIG. 8B, but with a round convergent nozzle 218 at the entrance of the second expansion chamber 128;

FIG. 9 shows an integrated barrel CUSPS, similar to the preferred embodiment, with ejector vent holes 104 before the barrel exit and surrounding the barrel 103.

While the preferred CUSPS has lobed internal nozzles 116, 117, it could instead have slotted rounded internal nozzles. Both types have divergent area distributions to minimize flow overexpansion and reduce noise and flash.

Tubular housing 102 need not be circular in cross section. Its major axis is preferably horizontal (i.e., co-axial with the firearm barrel 103, or alternatively vertical (not shown), or in between (not shown).

Experimental and analytical analyses of the preferred CUSPS embodiment 100 performed by the Applicants indicate: the CUSPS can reduce the noise induced by the firearm's muzzle blast wave, reduce the radiant flash caused by the propellant gases and ingest ambient an to both cool the suppressor and purge it of residual gases, thereby increasing its useful life span.

Based on their experimental and analytical results, and the observation that the vent holes permit easier flushing of the interior volume with cleaning fluids, the Applicants believe the preferred CUSPS embodiment 100 will reduce the blast wave induced noise at three feet from the muzzle exit by 20 db or more, make the gas flash visually undetectable to an observer at any distance greater than 1000 muzzle diameters, and have an indefinite useful lifetime if properly maintained.

In the preferred embodiment 100, the entrance and lobed nozzle 116 serves to control and reduce the static pressure of the gases exiting the muzzle while the vent holes 104 first dissipate the blast wave from the muzzle gases and thereafter ingest ambient air to purge, dilute and cool the residual gases. The ejector 117 lobes assist and amplify the air ingestion process, stir the ingested air into the muzzle gases to enhance their cooling and reduce the strength of the shock waves produced, which are further assisted by the convergent/divergent diffuser 127. Applicants believe their other disclosed embodiments will do the same.

The internal diameter of Applicants preferred suppressor housing 102 is between two and ten muzzle external diameters to accommodate the range of propellant gases used in the firearm. The CUSPS suppressor length is set between three and ten times its internal diameter to tailor its sound reduction to a desirable level.

Applicants have also presented, in FIGS. 10A and 10B, an alternate configuration for the tubular housing 102 of the preferred CUSPS embodiment 100. The housing employs a non-circular cross-section, here an oval.

The placement, number and size of the vent holes 104 are established to assure sufficient dilution of the muzzle gases to reduce flash and purging of the residual gases.

The entrance divergent nozzle's exit diameter and length are established using classic gas dynamic principals to produce isentropic, or near isentropic, expansion of the muzzle gases into the suppressor.

The exit nozzle diameter and length are established using classic gas dynamic principals to produce isentropic, or near isentropic, expansion of the muzzle gases out of the suppressor.

The mixer lobes, slots, tabs or swirl vanes have longitudinal, azimuthal and/or radial dimensions approximately equal to the radial dimensions of the entrance nozzle exit diameter and the suppressor internal diameter.

The ejector diameter is set between that of the entrance nozzle exit diameter and the suppressor internal diameter.

While the preferred embodiments are detachable from a gun, they can be affixed, more permanently, to the barrel.

Each of Applicants embodiments can be thought of as a firearm suppressor comprising:

a. a suppressor housing, with vent holes; extending from the muzzle end of a firearm barrel; and b. means for controlling and reducing the static pressure of muzzle gases exiting the muzzle of a discharged firearm while dissipating a blast wave from the muzzle gases and thereafter ingesting ambient air through the vent holes to purge, dilute and cool the residual gases, wherein the means comprises at least one mixer/ejector stage in the housing.

Each of Applicants' CUSPS embodiments also can be thought of in method terms. For example, a method for firearms, and other guns, comprising:

a. attaching a suppressor onto the muzzle end of a firearm, whereby the suppressor is co-axial with a barrel of the firearm.

b. controlling and reducing the static pressure of muzzle gases exiting the muzzle of a discharged firearm, via at least one mixer/ejector in the firearm suppressor, while dissipating a blast wave from the muzzle gases and thereafter ingesting ambient air through the vent holes to purge, dilute and cool the residual gases.

It should be understood by those skilled in the art that obvious structure modifications can be made without departing from the spirit or scope of the invention. For example, the same technique could be used for artillery or other guns.

We claim:

1. A firearm suppressor comprising:

a. a suppressor housing, with vent holes, extending from the muzzle end of a firearm barrel; and b. means for controlling and reducing static pressure of exit gases exiting the muzzle of a discharged firearm while dissipating a blast wave and thereafter ingesting external air through the vent holes to purge, dilute and cool residual gases, wherein the means comprises:

i. a first-stage mixer/ejector in a first expansion chamber inside the housing, comprising a lobed mixer nozzle and a first lobed ejector, wherein the first-stage mixer/ejector is adapted in size and shape to use the kinetic energy of the exit gases to pump external air in and through the vent holes, and wherein contours of internal lobes for the lobed mixer nozzle and the first lobed ejector interact to mix the ingested external air with the firearm's exit gases to reduce firearm noise and flash; and ii. a second-stage mixer/ejector inside the housing comprising the first lobed ejector operating as a second-stage mixer, and a second lobed ejector nozzle in an entrance of a second expansion chamber which extends downstream into the second expansion chamber.

2. The suppressor of claim 1 wherein the means further comprises:

a. a projectile entrance port in the housing, adjacent the muzzle end, which is adapted in size and shape to allow a blast wave and exit gases from a discharged firearm, upon exiting though the muzzle end, to expand inside the expansion chamber;

b. a round divergent nozzle, at the projectile entrance port, having a divergent area distribution adapted in size and shape to reduce flow over-expansion and shock formation, thus reducing flash; and c. a projectile exit port at a terminus end of the housing, wherein the exit port is an exit hole in the housing which is substantially larger than a bore of the barrel.

3. A firearm suppressor comprising:

a. a suppressor housing, co-axial with and extending from the muzzle end of a firearm barrel, wherein the housing has vent openings radially and longitudinally distributed, and the housing contains:

i. a projectile entrance port adjacent the muzzle end, which is adapted in size and shape to allow a blast wave and exit gases from a discharged firearm, upon exiting though the barrel, to expand inside the housing;

ii. a projectile exit port at a terminus end of the housing, wherein the projectile exit port is an exit hole in the housing which is substantially larger than a bore of the barrel;

iii. a first expansion chamber to increase pressure loss and reduce noise;

iv. a first-stage mixer/ejector in the first expansion chamber, comprising a lobed mixer nozzle and a first lobed ejector, wherein the first-stage mixer/ejector is adapted in size and shape to use the kinetic energy of the firearm's exit gases to pump external air in and through the vent holes, and wherein contours of internal lobes for the lobed mixer nozzle and the first lobed ejector interact within the housing to mix ingested external air, drawn in through the vent holes, with the exit gases to reduce firearm noise and flash;

v. a round divergent nozzle, at the projectile entrance port, having a divergent area distribution adapted in size and shape to reduce flow over-expansion and shock formation, thus reducing flash; and vi. a second-stage mixer/ejector comprising the first lobed ejector operating as a second-stage mixer, and a second lobed ejector nozzle which surrounds an end of the first lobed ejector and which extends downstream into a second expansion chamber; and b. vent holes in the second expansion chamber.

4. The suppressor of claim 3 wherein the housing further includes a contoured convergent/divergent diffuser at the housing's exit to maximize ejector pumping efficiencies.

5. The suppressor of claim 3 wherein the suppressor is integrated into the firearm barrel.

6. The suppressor of claim 3 wherein the housing is detachable from the barrel.

* * * * *